US005771560A

United States Patent [19]

Meroni et al.

[11] Patent Number: 5,771,560

[45] Date of Patent: Jun. 30, 1998

[54] METHOD FOR THE CONTINUOUS CASTING OF LONG PRODUCTS AND RELATIVE CONTINUOUS CASTING LINE

[75] Inventors: Umberto Meroni; Domenico Wogler Ruzza, both of Udine; Gianni Gensini, Buia; Dario Lestani, Bicinicco Fraz.Cuccana, all of Italy

[73] Assignee: Danieli & C. Officine Meccaniche SpA, Buttrio, Italy

[21] Appl. No.: 693,796

[22] Filed: Jul. 31, 1996

[30] Foreign Application Priority Data

Aug. 2, 1995 [IT] Italy ..... UD95 A 000151

[51] Int. Cl.[6] ..... B21B 1/46; B21B 1/26

[52] U.S. Cl. ..... 29/527.7; 29/33 C; 29/33 S; 29/DIG. 5; 164/476; 164/477; 164/417

[58] Field of Search ..... 164/476, 477, 164/417; 29/527.5, 527.7, DIG. 5, 33 C, 33 S, 650, 527.6

[56] References Cited

U.S. PATENT DOCUMENTS

| | | | |
|---|---|---|---|
| 3,209,452 | 10/1965 | Schneckenburger | 164/417 X |
| 3,358,358 | 12/1967 | Jenks et al. | 164/476 |
| 3,483,915 | 12/1969 | Schneckenburger et al. | 164/417 X |
| 3,491,823 | 1/1970 | Tarmann et al. | 164/476 |
| 3,693,701 | 9/1972 | Waclawiczek | 164/417 X |
| 3,710,841 | 1/1973 | Baumann | 164/476 |
| 4,793,169 | 12/1988 | Ginzburg | 164/476 X |
| 5,082,047 | 1/1992 | Bricmont | 29/527.7 X |
| 5,113,678 | 5/1992 | Mannaka et al. | 29/527.7 X |
| 5,419,387 | 5/1995 | Cryderman et al. | 164/417 |
| 5,584,337 | 12/1996 | Nakashima et al. | 164/477 |
| 5,634,512 | 6/1997 | Bombardelli et al. | 164/477 X |

OTHER PUBLICATIONS

Patent Abstracts of Japan, vol. 010, No. 216 (M–502) 29 Jul. 1986 & JP–A–61 052975 (Kawasaki Steel) 15 Mar. 1986 – Abstract.

Patent Abstracts of Japan, vol. 009, No. 152 (M–391) 27 Jun. 1985 & JP–A–60 027460 (Shin Nippon Seitetsu KK) 12 Feb. 1985 –Abstract.

Steel TImes –Incorporating Iron & Steel, vol. 221, No. 10 Oct. 1993, Longon pp. 432–433 Danieli goes Ahead WIth Thin Rolling.

Steel Times –Incorporating Iron & Steel, vol. 220, No. 11 Nov. 1992 London pp. 524–525, Gottardi et al "Net and Near Net . . . Casting".

Stahl Und Eisen vol. 113, No. 2 Feb. 1993 pp. 49–54, Hoffken CPR –Cast Pressing Rolling.

Patent abstracts of Japan, vol. 14, No. 97, M–0940) 22 Feb. 1990 & JP–A–01 306004, (Mitsubishi Heavy Ind, Ltd) Dec. 11, 1989, abstract.

"Handbook on Continuous Casting," E. Herrmann, Publiched 1980. Aluminium–Verlag GmbH, P.O. Box 1207, Konigsallee 30, D–4000 Dusseldorf, Germany.

*Primary Examiner*—Horace M. Culver
*Attorney, Agent, or Firm*—Antonelli, Terry, Stout & Kraus, LLP

[57] ABSTRACT

Method and continuous casting line for the continuous casting advantageously, but not only, of long products such as billets or blooms, whereby the solidification of the cast product (16) is completed at a position downstream of the outlet of the mould (13) and whereby the cast product (16) leaving a continuous casting machine (11) curving at a speed of at least 4 mts/min. is transferred into the horizontal segment with at least 12% of the section constituted by the liquid core without being sheared to size, the liquid core being solidified just before the cast product (16) is fed to a temperature-maintaining and pre-heating system and is then fed to a temperature-equalisation and fast-heating system and is fed lastly to a rolling train without any discontinuity and/or interruptions of the process, the preset casting speed bring at least higher than the critical speed of the rollers of the rolling train (18), and there being at least a stage, between the temperature-equalisation and fast heating system, where the core of the cast product (16) is tempered by the propagation of the surface heat, the temperature of the core and the surface of the cast product (16) being made uniform and homogeneous.

16 Claims, 1 Drawing Sheet

METHOD FOR THE CONTINUOUS CASTING OF LONG PRODUCTS AND RELATIVE CONTINUOUS CASTING LINE

BACKGROUND OF THE INVENTION

This invention concerns a method for the continuous casting of long products and also the continuous casting line which performs such method.

To be more exact, the invention is employed for the continuous casting and rolling of long products, such as billets and blooms in particular, without the need for laying up and/or temporarily storing the product and without the need for shearing the product to size at the outlet of the continuous casting machine and, within certain working and/or managing limits, without causing stoppages and/or pauses in the process.

In conventional continuous casting plants the continuous casting machine and the rolling train are normally components which are operationally disconnected and which require at least one intermediate element to act as a buffer stock and/or a temporary storage point.

This buffer stock has the purpose of compensating and managing the different production capacities of the components, namely the casting machine and rolling train, for the purpose of ensuring a working of the same according to the operational parameters found to be the best for the production of a product having high quality characteristics.

The plants of the state of the art are generally structured according to one of the two following types.

The first type of plant includes the continuous casting machine, the shearing to size, the cooling of the product to the ambient temperature, storage, subsequent heating to bring the product to the best temperature for rolling and then the rolling process.

This method entails a clear separation between the casting machine and the rolling train, high production costs, great space taken up, downtimes, a great labour force, operational difficulties in the handling, managing and storage of the products, etc.

The second type of process includes the casting, the shearing to size, the feeding of the strands into a buffer furnace positioned in line for equalisation of the temperature with possible movement of the strands within the furnace, and then the rolling process.

This second type of process makes possible the establishment of a closer working connection between the casting machine and the rolling train, a reduction of production costs and also the obtaining of an energy saving due to the lesser quantity of fuel employed for heating the product to be forwarded to the rolling process.

Moreover, this type of process entails a compacting and rationalisation of the spaces during design of the lay-out, with great advantages in the provision of the civil works, ridge cranes and therefore economies in investments of a structural type.

Another advantage which this process makes possible consists in the elimination of the handling of the raw product leaving the casting machine and the elimination of the storage and temporary stocking areas.

All this leads to an increase in the yield and efficiency of the plant and to a smaller labour force.

In this case too, however, there are still limits to the efficiency and output of the plant caused by the fact that the continuous casting machine and rolling train work in a partly disconnected manner without continuity, and there is still a need for an intermediate buffer stock which can meet the different working requirements of these components of the plant.

Moreover, there is still the difficult problem of the frequent necessity of removing the leading and trailing end portions of the strand inasmuch as the working process often does not enable a sufficiently good level of quality to be obtained in those portions.

This situation entails also a considerable scrapping of material, auxiliary components and operations, the need for continuous quality checks and yet other problems.

SUMMARY OF THE INVENTION

The present applicants have designed, tested and embodied this invention to eliminate all these shortcomings in the continuous casting plants of the state of the art and to achieve further advantages.

The purpose of the invention is to provide a continuous casting method and a relative line particularly, but not only, for long product such as billets or blooms, the method and line being suitable to make rational the use of the components in achieving an increase in working and management efficiency and a better output of the plant.

The invention provides a direct connection between the continuous casting machine and the rolling train without requiring the inclusion of buffer storage systems and/or separation between the two above components.

Moreover, the invention does not include the shearing to size of the product leaving the continuous casting machine but causes the product to arrive at the rolling train just as it has been fed continuously from the continuous casting machine.

According to the invention the continuous casting method arranges that the product after being cast is fed in line to a temperature-maintaining and temperature-equalisation system and is then rolled directly, still in line, without interruptions, diversions or pauses.

In this way, the method eliminates any type of lack of continuity and ensures high output, eliminates problems of stocking and/or storage and/or handling of the product and achieves a rational exploitation of the potentialities of every component of the plant.

Moreover, the problem of cropping the leading and trailing ends is wholly eliminated except at the steps of start-up and the end of casting.

This method according to the invention provides a high degree of coordination of the production speeds of the continuous casting machine and rolling train, so that none of the components of the plant, and in particularly the rolling train, is under-employed or has its potentiality only partly exploited.

According to the invention the line includes a continuous casting machine able to cast the product at a high speed, from about 5 to 6 mts/min. up to more than 8 mts/min. for instance according to the section being cast, and ensures a high level of quality; these high speeds not only ensure a rational employment of the rolling train in terms of productive efficiency but are the running speeds closest to the critical speed below which cracks and/or deformations are generated in the rolling rolls.

Downstream of the casting plant and after the straightening step there are included temperature-maintaining systems able to limit the losses of temperature of the product being fed at the low casting speeds which may be caused in transient situations upon the occurrence of some operational problem due to managing and/or production reasons.

The line according to the invention includes upstream of the rolling train a heating and/or temperature-equalisation system, the purpose of which is essentially to make uniform the temperature in the core and in the surface of the product and to bring that temperature to values suitable for rolling.

Between the heating and/or temperature-equalisation system and the first rolling mill stand of the rolling train there may advantageously be a distance which allows the core a re-heating time to complete the temperature-equalisation action so as to provide the rolling train with a product at a uniform and homogeneous temperature.

A descaling unit may be included immediately downstream of the heating and/or temperature-equalisation system so as to remove the scale from the surface of the product.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 1:
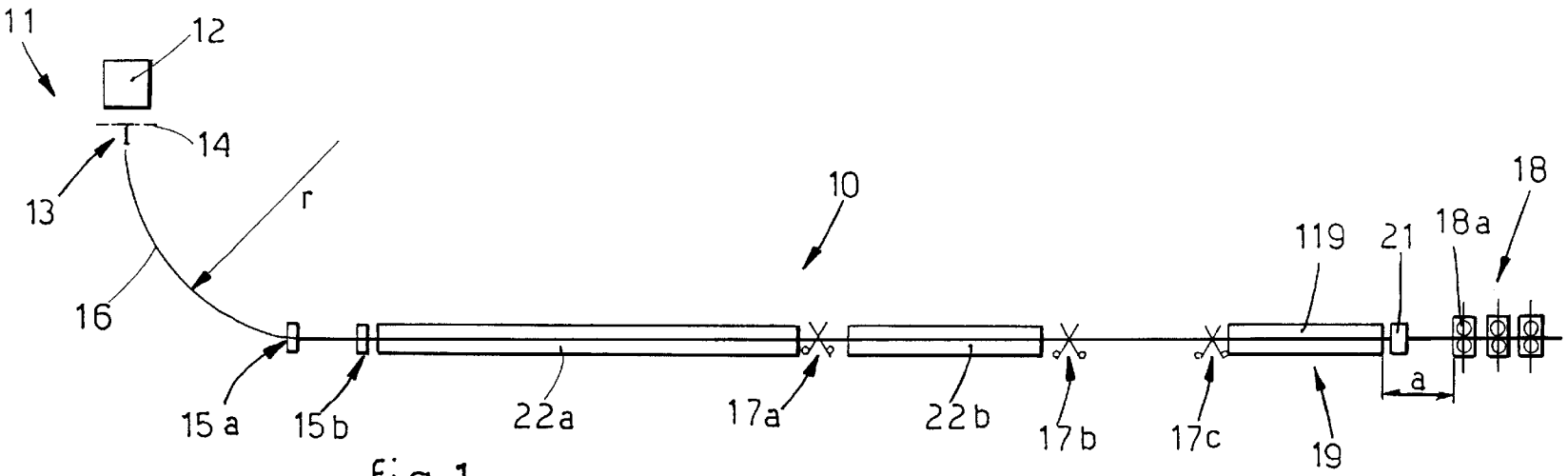
FIG. 1 shows a possible lay-out of the line for the continuous casting of long products according to the invention.

A continuous casting line 10 shown in FIG. 1 comprises a casting machine 11 consisting at least of means referenced with 12 for discharge of the molten metal and of a mould 13.

A line of dots and dashes 14 identifies, for example, the position of the meniscus of molten metal within the mould 13.

The straightening radius "x" of the casting machine 11 has been calculated to provide a compromise between the height of the casting machine 11, the reduction of the solidification segment and the temperature drop of the product 16 at the reduced casting speed.

The height of the machine is intentionally kept to the minimum possible value, compatible with the mechanical stresses to which the cast product is subjected. A curved machine is applied instead of a horizontal one, apparently this could be a logical solution, because experience has shown that horizontal casting is not able to sustain the rhythms of production which are required today, both as regards the maximum achievable speed of casting, and as regards operativeness (casting in long sequences, times required for resetting and maintenance).

A secondary cooling system downstream of the mould 13 is optimised to control the re-heating and to prevent the formation of surface and/or sub-surface cracks.

According to a variant the straightening curve downstream of the mould 13 is defined by a line having a plurality of radii for the purpose of limiting possible deformations of the product within pre-set limits.

The casting machine 11 employed in the line 10 according to the invention provides for completion of solidification of the cast product 16 at a position downstream of the outlet of the mould 13; this arrangement enables a possible process of controlled pre-rolling to be carried out at the outlet of the mould 13.

In view of the high casting speeds the cast product 16 still includes a liquid core of a great value when the product is already in the horizontal straight segment of the line 10.

According to the invention, the continuous casting machine comprises a short curved segment followed by a long horizontal segment in which the solidification of the billet is completed; in this segment there are electromagnetic stirrers, which are required to eliminate the structural asymmetry which would otherwise be the direct consequence of the fact that the solidification is carried out with the billet in a horizontal position.

In the segment between the outlet of the straightener/extraction unit and the pre-heating/temperature-equalization device (furnace), the inside of the billet is liquid and the solidification heat of this part is exploited to maintain the temperature of the surface layers at a raised temperature which is compatible with the process.

The billet is completely solidified immediately before the inlet to the heating/temperature-equalization device and enters this device without being sheared.

According to this concept, the rolling must take place in line, without interruptions in that it is impossible to shear the billet with a liquid core, and without accumulator systems, in that these can be made either by cutting the billet or blooms into blocks or with winding devices or other devices of this nature, which would not be applicable to a liquid core.

As we have said, in this example electromagnetic stirrers, which in this case are a first stirrer 15*a*, and a second stirrer 15*b*, are included substantially in the first horizontal segment of the line 10.

These electromagnetic stirrers 15*a*, 15*b* have the task of reducing the asymmetry of the internal solidification structure caused by the long horizontal segment of the line in which the solidification of the liquid core is completed.

The position and number of the electromagnetic stirrers 15*a*, 15*b* are adjusted according to the envisaged values of casting speed, the type of cast material and the cross-section of the product 16 being processed.

Normally, even with high-productivity machines, only a small part of the billet solidifies in the horizontal segment; according to the invention, however, this condition occurs for a significant percentage of the transverse section of the billet and that is 12–30% expressed as an area; that means that at a the beginning of the horizontal segment, the billet or bloom has at least 12% of the section with a liquid core. The invention does not include stirrers when the cast steel has no high quality requirements.

The line 10 downstream of the electromagnetic stirrers 15*a*, 15*b* includes temperature-maintaining systems consisting, for instance, of insulated hoods referenced in this case with 22*a* and 22*b*.

These insulated hoods 22*a*, 22*b*, which may be replaced with other temperature-maintaining systems having also a possible pre-heating function, have the purpose of limiting the losses of temperature in the cast product 16 passing through at the low casting speed.

In this case a first shears 17*a* is included between the first 22*a* and second 22*b* insulated hoods and is employed in emergency situations, for instance in the event of problems and/or interruptions and/or changes of cross-section in the rolling mill 18, thus making possible the provision of a buffer stock on the feeding roller conveyor upstream of the first shears 17*a*.

In such situations the casting speed is reduced without the need for halting the casting so as to provide the time for clearing the rolling mill 18 and performing the necessary restoration before the leading end of the product 16 reaches the point where the problem has occurred.

This reduced speed is a function of the normal operating speeds of the casting and of the lay-out of the plant and has to be set on the basis of a compromise between not causing great losses of temperature in the cast product 16 and maintaining the compact working of the overall plant.

According to a variant, upon occurrence of one of the above problems in the rolling mill 18, the cast product 16 is sheared by the first shears 17*a* and the casting process is halted for enough time to enable the rolling mill 18 to be cleared and the performance of the necessary actions of restoration to be carried out.

When restoration has ended, the casting is re-started.

In this case the means 12, for instance a tundish, discharging the molten steel into the mould 13 has to be configured in such a way as to prevent solidification of the molten steel therein.

In particular, this discharge means 12 has to be equipped, for instance, with plasma torches, means to maintain a controlled atmosphere, insulating cover means and special boxes of the tundish.

By using one or another of these buffer systems on the roller conveyor or on the molten steel in the tundish and by managing suitably the operating parameters linked to the interruption of the line, it is possible to obtain restoration times in the rolling mill 18 of about 15 to 20 minutes.

The first shears 17*a* can also be employed for providing special products such as billets sheared to size or other products.

Further shears 17*b*, 17*c* are included in this case at the outlet of the second insulated hood 22*b* and have the purpose of dealing with all the possible working situations which may occur in the line 10, such as obstructions in the rolling train 18 in particular.

A heating and/or temperature-equalisation system 19 is included upstream of the rolling train 18 and is advantageously of a fast heating type.

Figure 2:
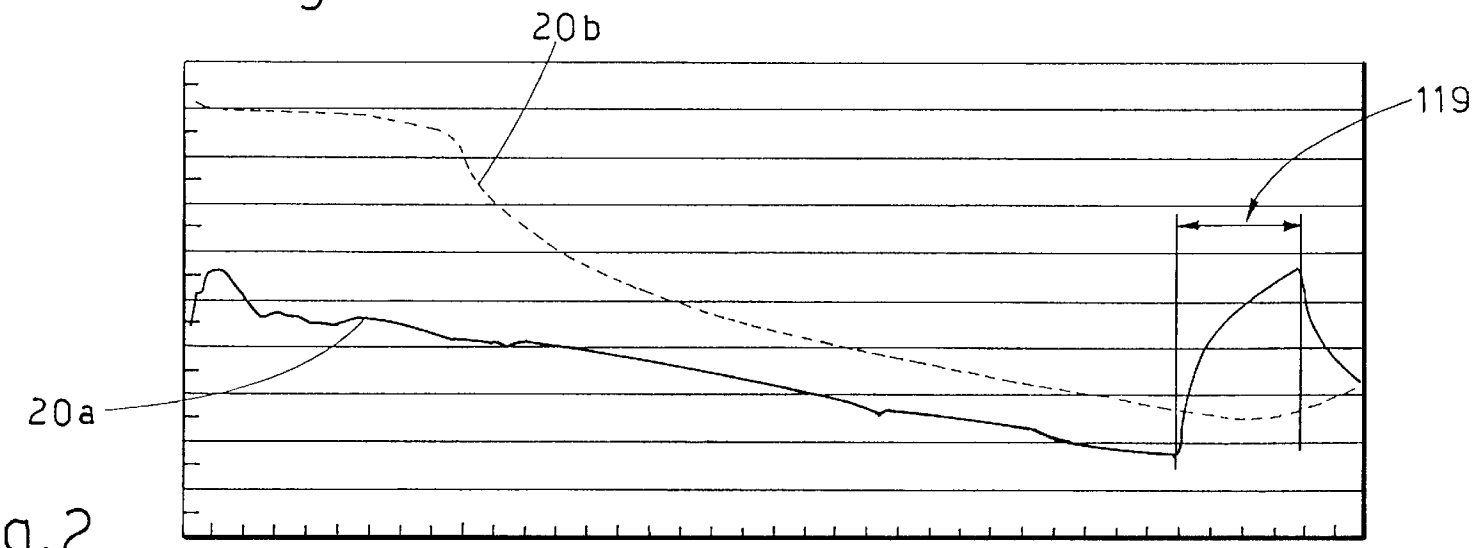
FIG. 2 is a diagram of the respective surface and internal temperatures taken on by the rolled product along the casting line shown in FIG. 1.

In this case the heating and/or temperature-equalisation system 19 comprises an induction furnace 119 within which the temperature of the cast product 16 is raised considerably; see FIG. 2, in which the line of dashes 20*b* shows the temperature of the core of the product 16, whereas the continuous line 20*a* shows the surface temperature.

The induction furnace 119 has working parameters, such as power, working frequency and length, which are such as will ensure the achievement of a homogeneous and uniform temperature in any type of product 16 under any working conditions which may occur. This situation enables a great flexibility and versatility of the line 10 to be ensured.

The achievement of an excellently homogeneous and uniform temperature throughout the whole cross-section of the product 16 enables problems of elongations, curving and deformations to be obviated which might occur during the rolling owing to any accentuated lack of homogeneity of temperature.

In this case, so as to reach optimum rolling temperatures at the core in transient situations of low speed, the temperature of the surface of the cast product 16 is raised to a high value; it is therefore necessary to determine an optimum distance "a" between the outlet of the induction furnace 119 and the inlet of the first rolling mill stand 18*a* in order that in this segment of a length "a" the hot core can be further heated and the surface can be cooled.

In this way the cast product 16 enters the first rolling mill stand 18*a* with a substantially uniform and homogeneous temperature at a value which can be determined according to the optimum rolling parameters.

At least one descaling unit 21 is included advantageously immediately downstream of the induction furnace 119.

This descaling unit 21 has the task of cleaning from the surface of the product 16 the scale and/or any other possible impurities which have already been split within the induction furnace 119 owing to the different thermal expansions of steel and scale.

We claim:

1. Method for continuous casting, whereby solidification of a cast product is completed at a position downstream of an outlet of a mould, the method comprising:

transferring the cast product from a curved continuous casting machine at a speed of at least 4 mts/min. into a horizontal segment with at least 12% of a section of the cast product having a liquid core without being sheared to size; completely solidifying the liquid core just before introducing the cast product into a temperature-maintaining and pre-heating system; then feeding the cast product to a temperature-equalisation and fast-heating system; then tempering the core of the cast product by propagation of its surface heat to make a temperature of the core and the surface of the cast product uniform and homogeneous; and then feeding the cast product to a rolling train without any discontinuity and/or interruptions of the process; wherein a preset casting speed is controlled to a speed at least greater than a critical speed of rollers of the rolling train.

2. Method as in claim 1, in which a descaling step is included at least downstream of the temperature-equalisation and fast heating system.

3. Method as in claim 1, in which the cast product upstream of the temperature-maintaining and pre-heating system cooperates with electromagnetic stirrers means cooperating with the liquid core.

4. Method as in claim 1, which includes the shearing of the cast product and a buffer storage step upstream of the shearing zone when situations of interruption in the line are caused by operational requirements.

5. Method as in claim 1, in which at the beginning of the horizontal segment the liquid core occupies at maximum 30% of the section of the cast product.

6. Method as in claim 1, in which the height of the casting machine is the least possible in function of the mechanical stresses to which the cast product is subjected.

7. Method as in claim 4, in which the buffer storage is carried out in the line on the roller conveyor feeding the cast product and entails at least the reduction of the casting speed as compared to the normal preset speed.

8. Method as in claim 7, in which the reduced casting speed in transient situations depends on the limiting of the losses of temperature in the cast product and on the limiting of the overall length of the line.

9. Method as in claim 4, in which the buffer storage is carried out on the molten steel in cooperation with the means discharging the steel into the mould.

10. Method as in claim 9, in which, at least in the step of buffer storage of the molten steel in the tundish, means able to prevent the solidification of the molten steel, such as plasma torches, means to maintain a controlled atmosphere, insulating cover means and special tundish boxes are actuated in cooperation with the means discharging the steel into the mould.

11. Continuous casting line which comprises: a continuous casting machine having a vertical casting segment, a horizontal segment in which a liquid core of the cast product is solidified, and a curved segment joining the vertical casting segment and the horizontal segment; temperature-maintaining means provided downstream of the horizontal segment; temperature-equalization and fast-heating means; and a rolling train, the line being characterized in that the above components are arranged in sequence in line, the cast product extending without a break of continuity from the casting machine to the rolling train and entering the temperature-maintaining means without being sheared.

12. Casting line as in claim 11, in which the speed of casting of the casting machine is at least 4 mts/min.

13. Casting line as in claim 11, in which at least one electromagnetic stirrer cooperating with the liquid core of the cast product is included in the horizontal segment upstream of the temperature-maintaining and temperature-equalization system.

14. Casting line as in any claim 11, in which a descaling unit is included at least immediately downstream of the temperature-equalisation and fast-heating means.

15. Casting line as in claim 1, in which at least one temperature-equalisation segment of a length "a" correlated with the maximum temperature reached by the core of the cast product within the temperature-equalisation and fast-heating means is included between the outlet of the temperature-equalisation and fast-heating means and the first rolling mill stand of the rolling train.

16. Casting line as in claim 11, in which at least one emergency shears is included at an intermediate position between the temperature-maintaining means and the temperature-equalisation and fast-heating means.

* * * * *